US008508446B2

(12) United States Patent
Biava et al.

(10) Patent No.: US 8,508,446 B2
(45) Date of Patent: Aug. 13, 2013

(54) ELECTRONIC CIRCUIT AND METHOD FOR DYNAMIC PILOTING OF LIGHT SOURCES IN VARIABLE MESSAGE INFORMATION PANELS

(75) Inventors: Giuseppe Biava, Brusaporto (IT); Stefano Ivaldi, Brusaporto (IT)

(73) Assignee: AESYS S.p.A., Brusaporto (Bergamo) (IT)

( * ) Notice: Subject to any disclaimer, the term of this patent is extended or adjusted under 35 U.S.C. 154(b) by 994 days.

(21) Appl. No.: 11/995,048

(22) PCT Filed: Jul. 13, 2006

(86) PCT No.: PCT/IT2006/000533

§ 371 (c)(1),
(2), (4) Date: Jan. 8, 2008

(87) PCT Pub. No.: WO2007/010581

PCT Pub. Date: Jan. 25, 2007

(65) Prior Publication Data

US 2008/0198106 A1 Aug. 21, 2008

(30) Foreign Application Priority Data

Jul. 15, 2005 (IT) ..... BS05A0088

(51) Int. Cl.
*G09G 3/32* (2006.01)

(52) U.S. Cl.
USPC ..... 345/82; 345/55; 345/42; 345/30

(58) Field of Classification Search
USPC ..... 345/82, 46, 55, 30
See application file for complete search history.

(56) References Cited

U.S. PATENT DOCUMENTS

| | | | | |
|---|---|---|---|---|
| 4,011,557 | A * | 3/1977 | Chetelat et al. | 345/44 |
| 4,065,716 | A * | 12/1977 | O'Brien | 324/96 |
| 4,183,021 | A * | 1/1980 | Gerstner | 345/39 |
| 4,198,629 | A * | 4/1980 | Marion | 345/46 |
| 4,743,897 | A * | 5/1988 | Perez | 345/212 |
| 5,959,413 | A * | 9/1999 | Komarek et al. | 315/306 |
| 7,378,630 | B2 * | 5/2008 | Yoshida | 250/205 |
| 2004/0090403 | A1 * | 5/2004 | Huang | 345/82 |
| 2006/0050032 | A1 * | 3/2006 | Gunner et al. | 345/82 |

FOREIGN PATENT DOCUMENTS

| | | | |
|---|---|---|---|
| DE | 257 160 | A1 | 6/1988 |
| DE | 40 22 166 | A1 | 1/1992 |
| EP | 0 967 590 | A1 | 12/1999 |

OTHER PUBLICATIONS

Peltz G: "Strompsparende Mehrfachanzeige . . . Fur Vier Bis Acht Leds" Nov. 1, 1985, Elektronik, p. 118, XP000111089 ISSN: 0013-5658.

* cited by examiner

*Primary Examiner* — Christopher E Leiby
(74) *Attorney, Agent, or Firm* — McGlew and Tuttle, P.C.

(57) ABSTRACT

The invention concerns an electronic circuit for dynamic command of light sources in variable message information panels. It includes a number of elementary circuits consecutively connected between them, each having at least one LED connected through respective switchable branches, to a feed voltage, to a LED short-circuiting line, to a contiguous elementary circuit and to a component or a control circuit output. Thus, by commanding the switching elements through the control circuit several elementary circuits can be selectively configured as closed circuits, each of which having a chain of LEDs activated in dynamically variable numbers wherein the feed voltage is applied to the feed branch of the first active LED of the chain and the control circuit output is closed on the last active LED of the activated LEDs chain.

20 Claims, 5 Drawing Sheets

ELECTRONIC CIRCUIT AND METHOD FOR DYNAMIC PILOTING OF LIGHT SOURCES IN VARIABLE MESSAGE INFORMATION PANELS

FIELD OF THE INVENTION

The present invention generally concerns light emitting variable message panels for public information, such as traffic information panels, public information service panels in stations and airports, information panels mounted on vehicles, advertisement panels, etc. This invention particularly refers to an innovative electronic circuit for commanding light sources, such as light emitting diodes (LEDs), pixels, clusters and other similar systems to be used in said panels.

PRIOR ART

It is well known that variable message informative panels (to follow, VMP) considered in this case are commanded to obtain visualisation of a message or a graphic image through selective and targeted switching on and off of visualisation elements made up of one or two light sources, such as LEDs, defining elementary points or light areas usually called pixels, clusters or else.

Each variable message panel has a front displaying area, and the LEDs are arranged on a visualisation surface activated according to a reference reticule, commonly known as matrix, whose intersections are the centres of the elementary luminous points or areas, i.e. pixels.

The visualisation surface of a VMP is usually made up of a group of single electronic modules, on which LEDs are physically installed, known as LED cards. These cards can be placed next to each other, composed and connected between them in various ways to create a different types and sizes of visualisation surfaces.

According to the state of art, various methods of commanding LEDs on a variable message panel are available and already widely used, and every type of command corresponds to a specific electronic circuit.

In FIGS. 5 and 6 of the enclosed drawings two different circuits indicative of the state of art, with the same number of LEDs, are shown for a comparison, respectively representing:

1. a static command circuit
2. a dynamic command circuit

Depending on the state of art, both the static and dynamic circuits require a part of current supply control or current circuit in AC and a part of the control or circuit control in DC.

The AC feeding circuit, where necessary, has a voltage converter which transforms feed voltage VAlim at the input of the same circuit (for example, 12 Volts or 24 Volts) into output voltage (VLED) required for correct feeding of LEDs.

The feeding circuit, in the process of transforming input voltage into output voltage usually has a loss of power that is proportional to an electrical performance typical of the same circuit. Given that the electrical performance is usually quantifiable at around 80%-90%, this obviously means that generating an power suitable to command the LEDs of a VMP implies loss of around 10%-20%, of power. This power is transformed into dispersed thermal energy.

On the other hand, the DC command circuit is made up of a group of electronic and electric components connected in a way to allow, by means of an external switch control, targeted switching on and off of the LEDs and so even the elementary light areas.

A static control circuit includes as the main part—but not the only one—an appropriate number of electronic control components (typically sliding registers) characterised by data memorisation capacity, and which have to be made sliding within the circuit and direct towards their proper outputs.

At the moment, each pixel of a circuit is practically electrically independent, since it is separately fed from the remaining pixels that make up the VMP.

This kind of independent feeding always requires a standalone controllable closed electric circuit, for each pixel or a part of it when consisting of a semi-pixel, also known as branch. The closed electric circuit is defined during project stage and it cannot be modified later on by the commanding control.

In addition, each closed electric circuit foresees that a sliding register output shall be assigned to each pixel, or to each semi-pixel or branch.

The register output, which basically operates as a switch and/or regulator, allows the closure of the electric circuit leading to the flow of current and commanding of the LEDs, pixels or semi-pixels connected to it. It is also well known that each sliding register output is associated to a loss of power either depending on the type of component or the command circuit used. Thus, a power loss is correlated to each independent command.

The use of static and dynamic circuits, that is the use of technology foreseeing the use of these circuits, and the use of a feeding circuit and connecting each pixel or semi-pixel to the independent output of the control component is obviously a disadvantage. As a matter of fact, we will have a circuit whereby part of the total power dispersed is due to the lacking charge of the voltage converter, if foreseen, and due to the power lost at each active sliding register output, that is by each independent closed command circuit.

Basically, the losses can be compared both in static and in dynamic circuit.

Same applies even when referring to pixel cards or clusters instead of LED cards.

OBJECTS AND SUMMARY OF THE INVENTION

Starting from these preliminary statements, this invention aims at introducing an innovative and reliable electronic circuit, in which loss of power is substantially limited, leading to a reduction of the power required for its use in VMP to allow installation of these panels even in the presence of limited electric power and general reduction of operational costs and overheating.

In addition, the invention aims at introducing an electronic circuit for the above mentioned uses, in which the circuit input voltage can be directly used to feed the LEDs or pixels without the use of a voltage converter or a feeder and thus can be profitably connected to a battery, even at a very low voltage.

Compared to the state of art, another aim of the invention is to reduce—having the same number pixels activated—the number of closed circuits required for their activation in VMPs. In addition, there is the possibility, if needed, to selectively vary the number of simultaneously activated closed circuits from time to time, even depending on the voltage of the feed source, in a way to match the power step by step.

Another aim of the invention is to allow the use of electric or electronic materials such as cables, terminals, etc, suitably sized to undertake lower voltage compared to the equivalent traditional circuits.

The above mentioned objective are achieved in accordance with the invention, through an electronic circuit complying with claim 1 with a command method according to claim 5.

BRIEF DESCRIPTION OF THE DRAWINGS

The invention will however be described in more details further ahead with reference to the enclosed, indicative but not limiting, drawings in which:

FIG. 1*a* is the diagram of FIG. 1 wherein the LEDs switched on;

FIGS. 4 and 4*a* are a comparison between a part of the electronic circuit of FIG. 3 and a part of a static command circuit according to the state of art in FIG. 5, both having the same number of LEDs switched on;

DETAILED DESCRIPTION OF THE INVENTION

Figure 1:
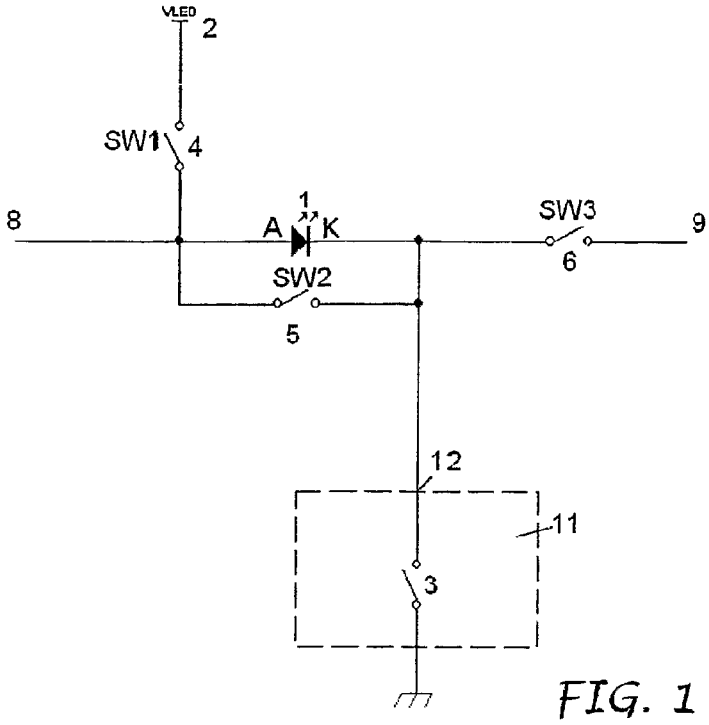
FIG. 1 is a diagram of an elementary electronic circuit according to the invention.

In FIG. 1 an elementary electronic circuit including at least one LED (1), a feed terminal (2), a circuit closure point (3) and a number of components SW1 (4), SW2 (5) and SW3 (6) with switch functions are shown. An input node (8) and an output node (9) complete the elementary circuit. In this elementary circuit, the LED (1) has anode A electrically connected to the feed point (2), through a switchable branch on which the first interrupter SW1 (4) is positioned, to the closure point (3) through a switchable branch on which a second component SW2 (5) is fixed and to the circuit input node (8). Cathode K of the LED (1) is electrically connected both to the closure point (3) and, through a switchable branch on which a third component SW3 (6) is fixed, to the circuit output node (9). The positions of these components can also be varied by locating, for example, the component SW3 (6) on the anode connection branch of the diode at the circuit input node (8) as longer as the operation principle is maintained.

Figure 2:
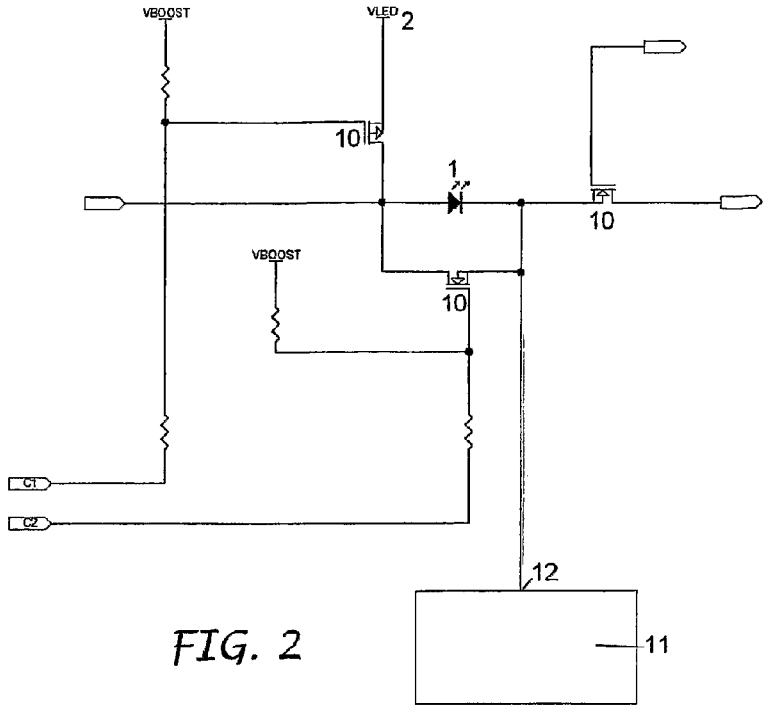
FIG. 2 is an electric diagram of the elementary electronic circuit in FIG. 1.

In FIG. 2 an elementary circuit is represented for example in which a suitably polarized MOS-FET (10) transistor is used instead of the SW1 (4), SW2 (5) and SW3 (6) switches in FIG. 1 is shown.

Figure 3:
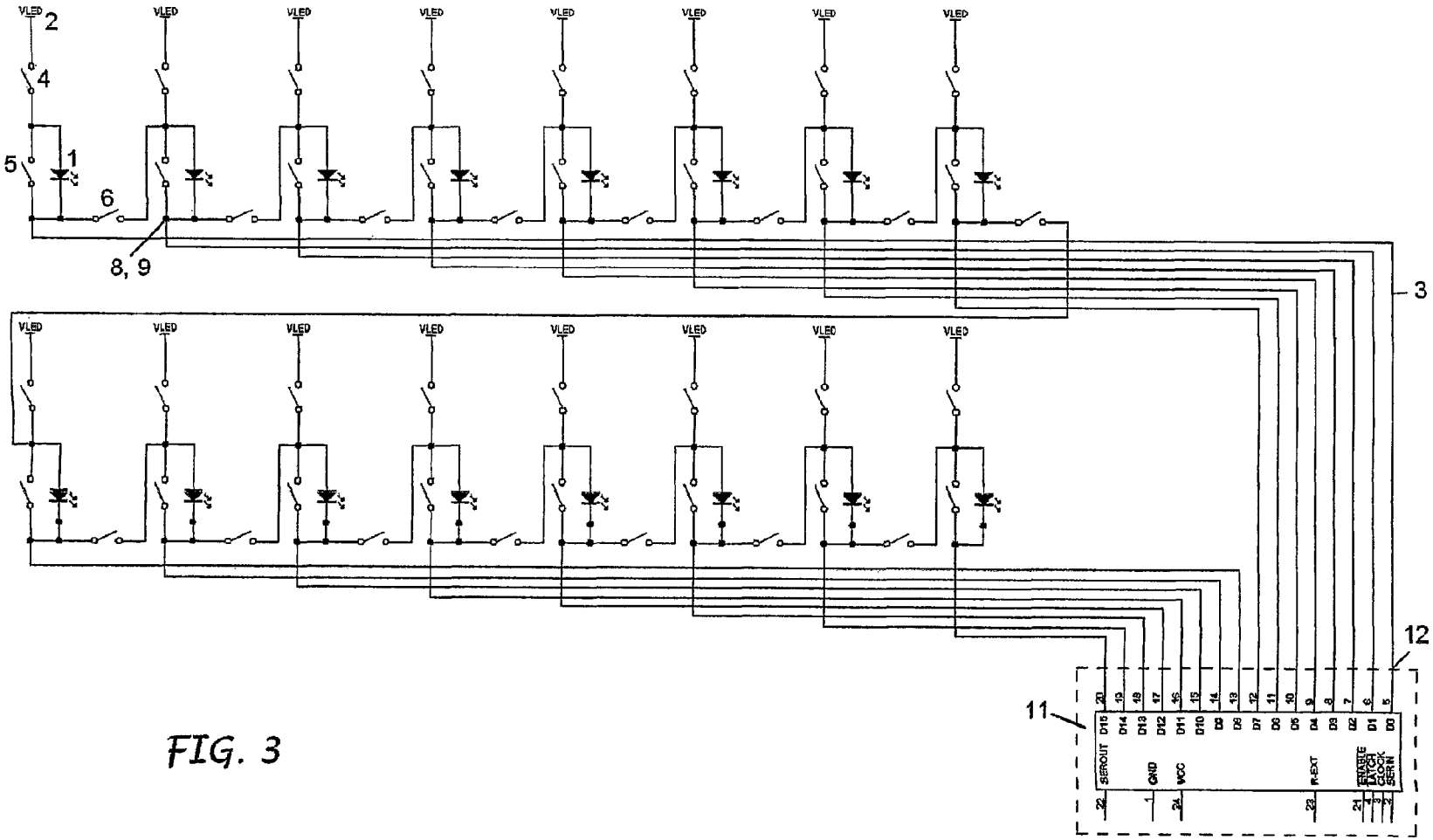
FIG. 3 is a schematic view of a number (sixteen) of elementary electronic circuits connected in a way to create a matrix.

As shown in FIG. 3, the circuit elementary output node (9) can be connected to the input node (8) of a following, similar elementary circuit. In addition, the closure point (3) of each elementary circuit can be connected to a component or control circuit (11). In the indicative but not limiting example shown in FIG. 3 the control component (11) used is a sliding register and each closure point (3) is connected to an output (12) said register.

Figure 1A:
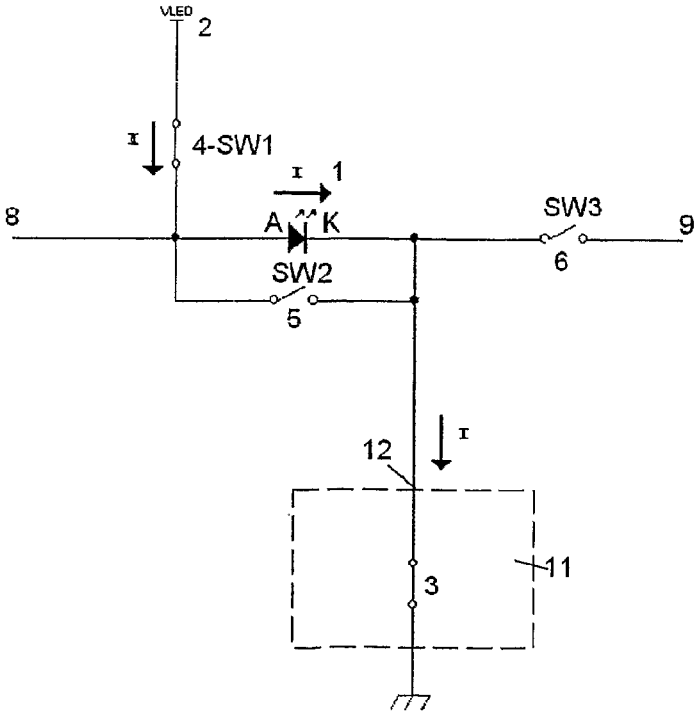

In the embodiment according to the diagram in FIG. 3, a complex circuit made up of a plurality of elementary circuits is shown, where each elementary circuit is normally open and in which its relative LED (1) can be switched on by applying an appropriate amount of power on the feed point (2), closing SW1 (4), suitably operating on the closure point (3) in the sense of closing it towards the output of the control component, but leaving component SW2 (5) (FIG. 1*a*) open. Targeted closure of component SW3 (6) instead, allows connecting an elementary circuit output to the input of the following elementary circuit. On the other hand, a targeted closure of component SW2 (5) allows bypassing the LED without activating it and connecting a previous elementary circuit to the following one (but not contiguous), even though at a distance of one or two interposed elementary circuits.

So, commanding components SW1, SW2, SW3 through the control circuit 11, it is possible to selectively activate the elementary circuits, in a variable number or all simultaneously, in order to activate/disable the light sources—i.e. the LEDs—partially or totally depending on necessity, dynamically creating active LED chains (switched on) that can be alternated with disabled (switched off) LEDs depending on the message to be displayed.

Figure 4A:
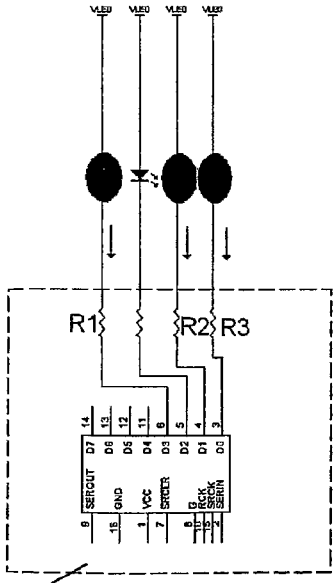
Figure 4:
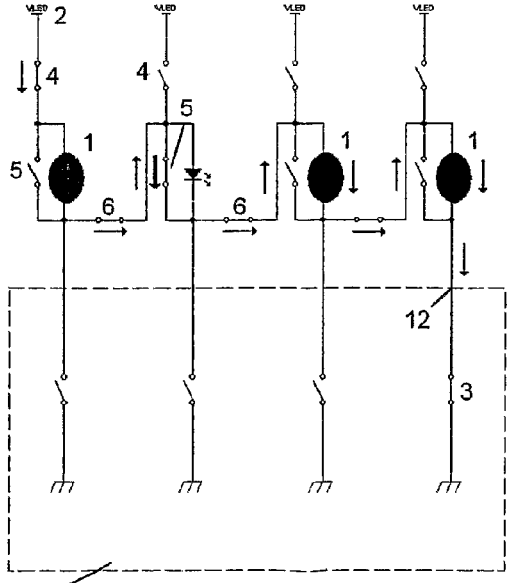

The activated LEDs chain may include a number of elementary circuits, and so even LEDs, that vary even depending on the voltage of the feed source, practically creating a single circuit, wherein the VLED electric feed is applied on the feed point 2 of the elementary circuit of the first of said activated LEDs and the output 3 towards control component 11 is closed on the last of the activated LEDs of the chain as shown in FIG. 4, whereas in a traditional command circuit each active LED is fed with power through its respective closed circuit as shown in FIG. 4*a*.

In this way the LEDs can be fed in groups, in chains instead of being fed singularly, with the possibility of reducing in one VMP, with an identical number of LEDs activated for the visualisation of a given message, the number of outputs of the control circuit and so the points on which loss of power occurs.

As an example, in FIGS. 4 and 4*a* (though only partially), respectively there are represented the command circuit diagram according to this invention and a traditional circuit diagram in each one of which three out four LEDs are activated (switched on). While in the traditional circuit activating the three corresponding outputs of the circuit control is necessary with the as much relative loss of power on R1, R2 and R3 resistance, in the circuit according to the invention, by suitably opening and closing the interrupters and bypassing the LED that must remain disabled, a single closed cycle activated may be realised, having a single output on the control circuit, with only one loss of power.

In addition, such a configuration allows eliminating the voltage converter since the power from the VLED feed source applied at the input of chain can be directly partitioned on a plurality of LEDs. Given that VF is the loss of power at the end of each LED for its activation, in this way you will have one or more chains made up of a number of active LEDs indicatively equal to VLEDNF. In other words, the number of activated LED chains may dynamically vary to suit the variations of the power at the input, thus saving more energy.

So, the control circuit will be managed by a suitable firmware, whose duty is to receive the message data to be visualised and the value of the feed voltage at the input, then supply in output the right command to activate each LED or LED chains whose length—where required, convenient or profitable—may vary depending on the instantaneous value of the VLED voltage feed.

Figure 5:
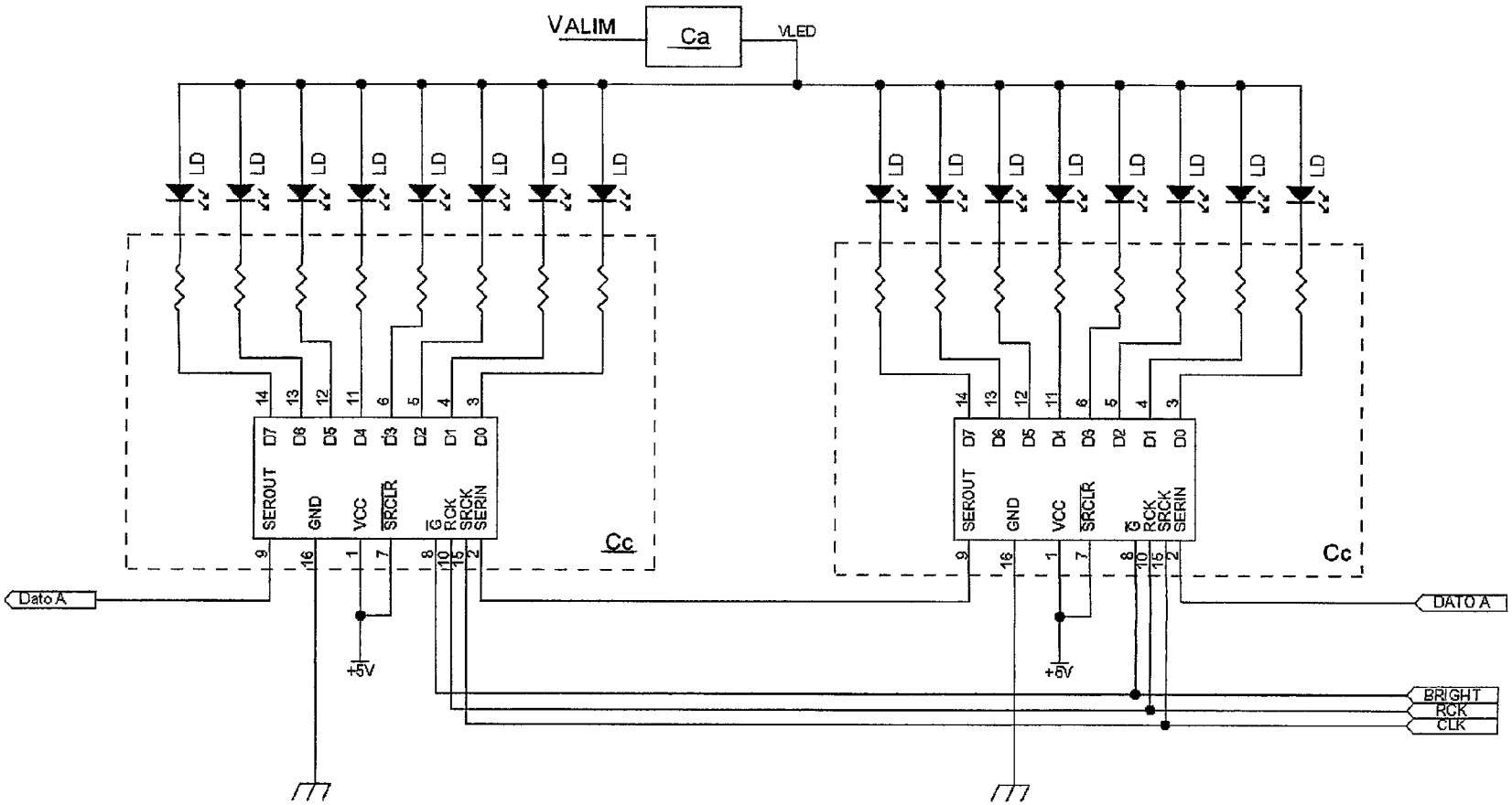
FIG. 5 is, as a comparison, a schematic view of a static command circuit according to the state of art.
Figure 6:
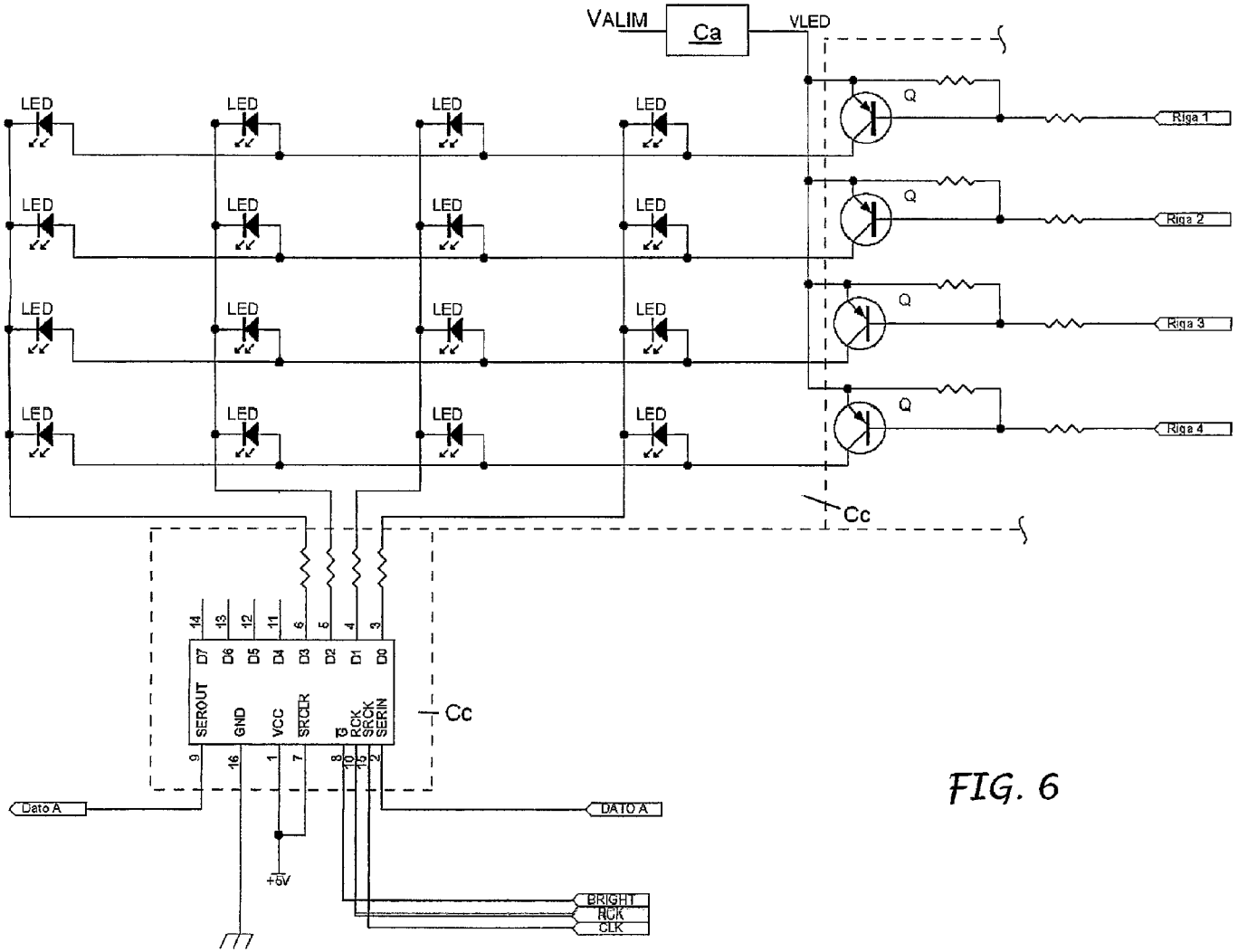
FIG. 6 is, still as a comparison, a similar schematic view of a dynamic command circuit according to the state of art.

By several elementary circuits, matrices can also be composed to be used in making variable message luminous panels. In FIG. 3 there is an example of sixteen elementary circuits matrices for the same number of LEDs corresponding by number to the matrices for the same use as shown in FIGS. 5 and 6, but with a totally different wiring and a command that leads, as said earlier on, to a reduction of loss of power.

The invention claimed is:

1. An electronic circuit for a dynamic control of lighting sources, such as LEDs, semi-pixels, pixels and clusters, in variable message information panels, the circuit comprising:

a plurality of elementary circuits consecutively connected in series to one another, each of said elementary circuits having a same configuration as another one of said elementary circuits, each of said plurality of elementary circuits having three switches and only one LED electrically connected to a current feed of a given value, a short-circuiting line of the LED, a contiguous elementary circuit and an output of a component or control circuit via respective said switches, wherein one or more of said elementary circuits are configured as closed circuits by piloting of said switches with said control circuit, each of said closed circuits having a chain of activated LEDs in a dynamically variable number, wherein a feed voltage is applied to a feed branch of a first active LED of the chain of activated LEDs and an output of said control circuit output is closed on a last active LED of the chain of activated LEDs, wherein one or more disabled LEDs are bypassed via a controlled closure of at least one of said switches on said short-circuiting line of said LED, wherein each of said elementary circuits is directly connected to a voltage source.

2. Electronic circuit according to claim 1, wherein on each branch of every elementary circuit a controllable interrupter element is provided through the control circuit, said interrupter elements being switches, transistors or like, and wherein the elementary circuits are normally opened keeping the relative LEDs disabled and they are selectively commanded through the control circuit so as to build chains of activated LEDs, each chain of activated LEDs configured as a single closed circuit.

3. Electronic circuit according to claim 1, wherein the active LEDs in each chain of activated LEDs, contained in a single closed circuit can be consecutive or alternated with disabled LEDs that can be switched off by closing the circuit interrupting element on the short-circuiting line of the relative diode.

4. Electronic circuit according to claim 1, wherein the number of active LEDs in each chain of activated LEDs contained in a single closed circuit is based on an amount of feed voltage and varies based on the above mentioned voltage, each of said elementary circuits comprising an output node and an input node, said input node of each of said elementary circuits being connected to said output node of at least another one of said elementary circuits, said three switches being connected to at least said input node.

5. Electronic circuit according to claim 1, wherein said three switches comprise a first switching element, a second switching element and a third switching element, each of said elementary circuits being connected to another one of said elementary circuits with said second switching element in a second switching element closed position, said first switching element of one of said elementary circuits being connected to said feed voltage with said first switching element in a first switching element closed position, wherein said feed voltage passes through each of said elementary circuits with said first switching element in said first switching element closed position, said second switching element in said second switching element closed position and said third switching element of a last one of said elementary circuits in a third switching element closed position, each of said elementary switches having an input node and an output node, each of said switches being arranged between said input node and said output node.

6. Electronic circuit according to claim 5, wherein said first switching element of another one of said elementary circuits is in a first switching element open position, said third switching element of said another one of said elementary circuits being in a third switching element open position.

7. Electronic circuit according to claim 5, wherein at least said first switching element of said one of said elementary circuits in said first switching closed position, said second switching element of each of said elementary circuits in said second switching element closed position and said third switching element of said last one of said elementary circuits in said third switching element closed position defines an electrical flow path, wherein said feed voltage is transmitted through said electrical flow path.

8. Electronic circuit according to claim 5, wherein said third switching element of said last one of said elementary circuits switches from an open position to a closed position via said output of said control circuit.

9. A method to implement dynamic command of light sources in variable message information panels, the method including the steps of:

arranging several elementary circuits, each of said several elementary circuits being consecutively connected in series to each other, each of said several elementary circuits having a configuration that is the same as a configuration of another one of said several elementary circuits, each one of said several arrangement elementary circuits having only one LED and three switching elements, said LED being connected electrically, through one or more of said three switching elements, to a feed voltage of a given value, to a short-circuiting line of diode, to a contiguous elementary circuit and to a circuit control output, one of said switching elements being arranged on said short-circuiting line of said diode, each of said elementary circuits being directly connected to a voltage source;

controlling said three switching elements of each of said several elementary circuits with said circuit control such that several elementary circuits are selectively configured as single closed circuits, each of said single closed circuits including a chain of LEDs activated in dynamically variable numbers by applying a feed voltage to a feed branch of a first active LED of the chain of activated LEDs and closing an output of the control circuit on a last active LED of the chain of activated LEDs, wherein a number of activated LEDs varies based on the feed voltage; and bypassing disabled LEDs through a controlled closure of one or more of the one of said switching elements arranged on the short-circuiting line of said diode.

10. Electronic circuit according to claim 9, wherein each of said elementary circuits is connected to another one of said elementary circuits with said second switching element in a second switching element closed position, said first switching element of one of said elementary circuits being connected to said feed voltage with said first switching element in a first switching element closed position, wherein said feed voltage passes through each of said elementary circuits with said first switching element in said first switching element closed position, said second switching element in said second switching element closed position and said third switching element of a last one of said elementary circuits in a third switching element closed position, each of said elementary circuits comprising an output node and an input node, one or more of said first switching element, said second switching element and said third switching element being connected to said input node and said output node.

11. Electronic circuit according to claim 10, wherein said first switching element of another one of said elementary circuits is in a first switching element open position, said third switching element of said another one of said elementary circuits being in a third switching element open position.

12. Electronic circuit according to claim 9, wherein an electrical flow path is defined by at least said first switching element of said one of said elementary circuits in a first switching closed position, said second switching element of each of said elementary circuits in a second switching element closed position and said third switching element of a last one of said elementary circuits in a third switching element closed position, said feed voltage passing at least from said first switching element to said third switching element of said last one of said elementary circuits via said electrical flow path, each of said elementary circuits comprising an output node and an input node, said first switching element, said second switching element and said third switching element being arranged between said input node and said output node.

13. Electronic circuit according to claim 10, wherein said third switching element of said last one of said elementary circuits switches from an open position to a closed position via said output of said control circuit.

14. An electronic circuit for a dynamic control of lighting sources, such as LEDs, semi-pixels, pixels and clusters, in variable message information panels, the circuit comprising:

a current feed;

a control circuit comprising an output;

a plurality of elementary circuits, each of said plurality of elementary circuits being directly connected to a voltage source and each of said plurality of elementary circuits having a first switching element, a second switching element and a third switching element, only one LED and a short-circuiting line of said LED, each of said plurality of elementary circuits being consecutively connected in series to another one of said plurality of elementary circuits of a same configuration via one or more of said first switching element, said second switching element and said third switching element, said LED and said short-circuiting line of said LED, at least one of said first switching element, said second switching element and said third switching element being arranged on said short-circuiting line of said LED, said LED being electrically connected to said current feed, said short-circuiting line of the LED, an adjacent one of said plurality of elementary circuits and said output of said control circuit via said first switching element, said second switching element and said third switching element, said control circuit closing one or more of said first switching element, said second switching element and said third switching element such that one or more of said elementary circuits define at least one closed circuit, said at least one closed circuit having a chain of activated LEDs, wherein a feed voltage is applied to a feed branch of a first active LED of the chain of activated LEDs and an output of said control circuit output is closed on a last active LED of the chain of activated LEDs, said control circuit closing at least one of said switching elements on said short-circuiting line of one or more LEDs such that said one or more LEDs is bypassed via said short-circuiting line to define at least one disabled LED.

15. Electronic circuit according to claim 14, wherein on each switchable connection branch of every elementary circuit a controllable interrupter element is provided through the control circuit, said interrupter elements being one or more of switches and transistors, wherein the elementary circuits are normally opened keeping the relative LEDs disabled and they are selectively commanded through the control circuit so as to build chains of activated LEDs, each chain of activated LEDs configured as a single closed circuit.

16. Electronic circuit according to claim 14, wherein the active LEDs in each chain of activated LEDs, contained in a single closed circuit are consecutive or alternated with disabled LEDs that are be switched off by closing the circuit interrupting element on the short-circuiting line of the relative diode.

17. Electronic circuit according to claim 14, wherein the number of active LEDs in each chain of activated LEDs contained in a single closed circuit is based on an amount of feed voltage and varies based on the above mentioned voltage.

18. Electronic circuit according to claim 14, wherein each of said elementary circuits comprises an input node and an output node, said output node of one of said elementary circuits being connected to said input node of an adjacent one of said elementary circuits, one or more of said first switching element, said second switching element and said third switching element being connected to said input node and said output node.

19. Electronic circuit according to claim 14, wherein each of said elementary circuits is connected to another one of said elementary circuits with said second switching element in a second switching element closed position, said first switching element of one of said elementary circuits being connected to said feed voltage with said first switching element in a first switching element closed position, wherein said feed voltage passes through each of said elementary circuits with said first switching element in said first switching element closed position, said second switching element in said second switching element closed position and said third switching element of a last one of said elementary circuits in a third switching element closed position.

20. Electronic circuit according to claim 19, wherein said first switching element of another one of said elementary circuits is in a first switching element open position, said third switching element of said another one of said elementary circuits being in a third switching element open position, said third switching element of said last one of said elementary circuits switches from an open position to a closed position via said output of said control circuit.

* * * * *